United States Patent [19]

Payne et al.

[11] 4,301,671

[45] Nov. 24, 1981

[54] SUPPORTED KNOCKOUT PIN ASSEMBLY FOR FORGING MACHINES OR THE LIKE

[75] Inventors: George T. Payne; Gerald R. Eakin, both of Tiffin, Ohio

[73] Assignee: The National Machinery Company, Tiffin, Ohio

[21] Appl. No.: 118,097

[22] Filed: Feb. 4, 1980

[51] Int. Cl.[3] ..... B21D 45/00

[52] U.S. Cl. ..... 72/344; 10/11 E; 72/427

[58] Field of Search ..... 72/344, 345, 427; 10/11 E

[56] References Cited

U.S. PATENT DOCUMENTS

| | | | |
|---|---|---|---|
| 2,057,418 | 10/1936 | Clorise | 10/11 E |
| 2,342,928 | 2/1944 | Fischer | 10/11 E |
| 2,758,322 | 8/1956 | Schoefer | 10/11 E |
| 2,960,949 | 11/1960 | Smith et al. | 72/345 |
| 3,280,613 | 10/1966 | Schrom | 72/344 |
| 3,357,228 | 12/1967 | Harrison et al. | 72/344 |
| 3,390,565 | 7/1968 | Smith et al. | 72/344 |
| 3,452,577 | 7/1969 | Schmeltzer et al. | 72/345 |
| 3,911,718 | 10/1975 | Requarth | 72/344 |
| 4,051,707 | 10/1977 | Voleb et al. | 72/345 |

*Primary Examiner*—Leon Gilden

*Attorney, Agent, or Firm*—Pearne, Gordon, Sessions, McCoy & Granger

[57] ABSTRACT

A kickout pin support system for forging machines or the like is disclosed in which a plurality of support members are provided to support the kickout pin at intermediate locations along its length so that the pin is not damaged by the loads applied thereto. The support members are movable to predetermined, spaced support positions by air pressure, and in such positions engage associated stop surfaces along the length of the passage in which they move. With the invention, proper support can be provided for a knockout pin of substantially any length by providing an appropriate number of support members spaced along the length of the knockout pin when the pin is in its retracted position.

18 Claims, 6 Drawing Figures

SUPPORTED KNOCKOUT PIN ASSEMBLY FOR FORGING MACHINES OR THE LIKE

BACKGROUND OF THE INVENTION

This invention relates generally to forging machines or the like, and more particularly to a knockout assembly providing novel and improved support means for the knockout pin.

PRIOR ART

Machines such as forging machines or the like are often provided with knockout rods or pins which are moved axially into a die to eject a workpiece from the die. In instances in which the knockout stroke is relatively long, there is a tendency for the pin to break if it is not supported at locations intermediate its ends. U.S. Pat. No. 2,057,418 to Clouse (assigned to the assignee of the present invention) describes one structure providing such intermediate support for a forging machine knockout pin. The support structure described in such patent, however, provides such intermediate support at only one location and is therefore unsatisfactory if the stroke of the knockout pin is sufficiently long to require more than one intermediate support. Generally, in forging machines the total unsupported length must be at least equal to the length of the kickout stroke, but to prevent breakage each section of unsupported length should not exceed about ten times the diameter of the pin. Consequently, the system disclosed in the Clouse patent is satisfactory only if the knockout stroke does not exceed about twenty times the diameter of the knockout pin.

SUMMARY OF THE INVENTION

In accordance with the present invention, a knockout pin support system is provided which can supply adequate intermediate support for a knockout pin having substantially any length of stroke. For example, in the illustrated embodiment of this invention the knockout pin is supported by three equally spaced support members which divide the pin into four unsupported portions or zones, each of which is sufficiently short to prevent pin breakage. It is within the scope of the present invention to provide even more spaced supports if the length of the knockout pin stroke requires an even greater number of points of intermediate support.

Each of the support members is positioned at a predetermined location within the passage through which the knockout pin extends when the knockout pin is in the retracted position. Such predetermined positions are selected to ensure that the knockout pin is sufficiently supported to prevent breakage under normal operating conditions. As the knockout pin extends to eject a workpiece, the support members move from the predetermined positions to allow the full ejection stroke in such a manner that the unsupported length of the knockout pin never exceeds the maximum unsupported length which initially exists. Normally, the predetermined positions are selected so that the support members are equally spaced along the length of the knockout pin so that when the pin is in the fully retracted position, the unsupported portions have an equal length.

When the knockout pin is in the fully extended position, all of the support members are adjacent to the forward end of the passage and are located with respect to the knockout pin at its rearward end. As the knockout pin moves back toward its retracted position, the support members move back along the passage until they reach their respective predetermined support positions, and when the knockout pin reaches its fully retracted position, all of the support members are at their spaced, predetermined positions for proper support. The return of the support members to their predetermined positions is ensured by air pressure, in the illustrated embodiment, which functions as an air spring to bias each of the support members toward their normal predetermined support positions.

In accordance with another important aspect of the invention, an improved knockout pin support system is provided with pneumatic spring means to bias the support member toward its normal support position while allowing the support member to move from said position as the knockout pin moves toward its extended position.

These and other aspects of the invention are fully described and illustrated in the following specification and drawings.

DETAILED DESCRIPTION OF THE PREFERRED EMBODIMENT

Figure 1:
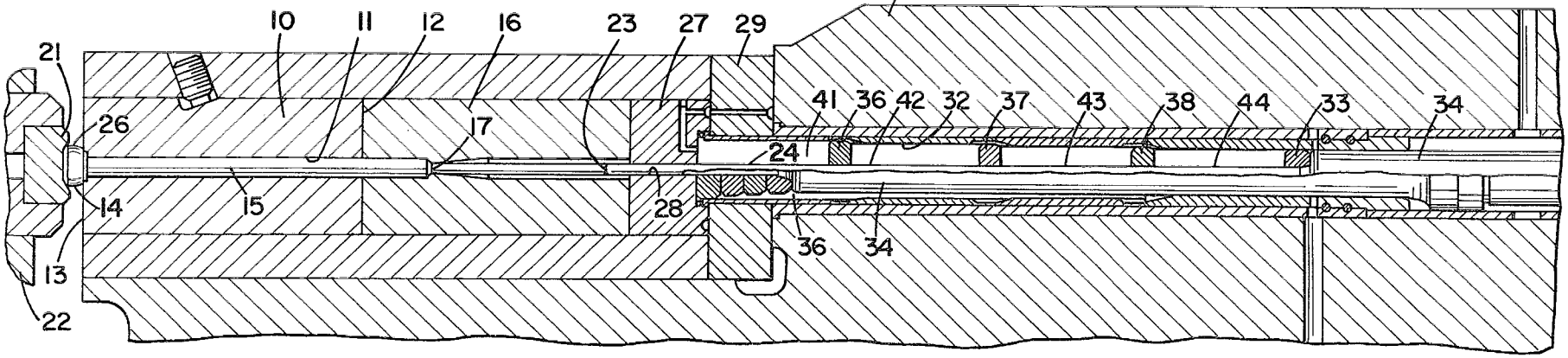
FIG. 1 is a fragmentary, longitudinal section, taken along the center line of a die and the associated knockout pin assembly, with the supports and the pin illustrated in retracted position in the upper half of the Figure and with the support system in the extended position in the lower half of the Figure.

FIG. 1 illustrates the present invention as applied to a machine for making relatively long bolts. Such machines, generally referred to as "progressive headers," provide a stationary frame in which a plurality of dies are located to progressively form the workpiece or blank. Mounted on the frame is a reciprocating header slide having tools associated with each of the dies which cooperate to progressively form a workpiece to the final shape required. Usually the machine also includes feed rolls which feed wire or rod stock to a shear. The shear automatically shears measured blanks from the forward end of the stock for transfer sequentially to each of the work stations. Such machines also include automatic transfer means which grip the workpiece at one station and transfer it to a position in alignment with the subsequent station. Such progressive headers are generally well known in the art, and reference may be made to U.S. Pat. Nos. 3,171,144 and 3,191,204 (both assigned to the assignee of the present invention) for a more detailed description of the overall machine.

The present invention is directed to the kickout or knockout mechanism provided at the work stations which operates to eject the blank from the die after the completion of the forming operation performed at such die. Such knockout assembly provides a knockout pin which is located at the inner end of the die during the forming operation and which must absorb a portion of the forming loads during the working of the blank or workpiece. After the forming operation is completed, the knockout pin is pushed forward along the die to eject the workpiece from the die, and must have a knockout stroke which is sufficient to move the workpiece clear of the die, where it is gripped by the transfer and transferred to the subsequent die station or work station.

Such knockout pin or rod has a diameter which is no greater than the smallest diameter of the opening within the die and is movable through a distance at least equal to the length of the workpiece located within the die. If the workpiece is short, the knockout pin need only move a short distance and breakage normally does not present a problem. On the other hand, when the workpiece is long with respect to its minimum diameter within the die, a relatively long and narrow or thin knockout pin is provided, and breakage presents a problem if adequate support cannot be provided. Further, since such knockout pins must be formed of relatively hard metal which cannot bend to any material extent without breakage, such support must be sufficient to prevent bending.

Not only must forming load be carried by the knockout pin, but also the pin must be able to withstand the load required to commence the movement of the blank out of the die, and such load can be very high, at least during the initial portion of the stroke, since the blank after the working operation tightly fits the die opening. Generally, after the commencement of the ejection mvoement, the load on the knockout pin decreases.

The Clouse patent, supra, illustrates and describes a structure for providing a single intermediate support on a knockout pin which divides the unsupported length of the pin into two portions. Consequently, with a mechanism as disclosed in the Clouse patent, the unsupported length of the pin can be about twenty times the diameter of the pin. However, when greater ejection pin lengths are required, the single support provided by the Clouse patent is not adequate in many instances.

With the present invention, a structure is provided in which substantially any number of intermediate support members may be provided along the pin so pins having substantially any required unsupported length can be properly supported against breakage. In the illustrated embodiment, the ejector pin is supported at three equally spaced locations along the length of the pin so that the pin has four substantially equal, unsupported portions, each of which can have a length up to about ten times the diameter of the pin. If greater length of ejection is required, it is within the scope of this invention to provide an assembly having a greater number of intermediate support members so as to maintain the required short unsupported length of the pin. It is also within the scope of this invention to provide less than three intermediate support members.

FIG. 1 illustrates the structure of the invention as applied to a work station in a progressive header for the manufacture of relatively long bolts. The illustrated die station or work station includes an outer die 10 having a die opening 11 extending from its rearward end at 12 to a forward face at 13. Formed in the forward face is a shallow cavity 14 in which the washer face of the bolt is formed and the passage or bore 11 has a uniform diameter from the washer face to the rearward end 12. Such uniform diameter is equal to the unthreaded diameter portion of the finished bolt.

Positioned behind the forward die is a rearward die 16 having a through passage with an extrusion throat 17 having a diameter equal to the diameter of the bolt blank along the portion of the bolt which will be ultimately threaded. The diameter of the throat 17 is approximately equal to the pitch diameter of the thread, so that after the thread rolling operation of the finished threads will have a maximum diameter substantially equal to the diameter of the unthreaded portion produced in the opening 11. The forward end of the rearward die 16 abuts the forward die.

Usually, such type of bolt is formed by selecting stock having a diameter substantially equal to the diameter of the passage 11, and as the end of the blank or workpiece is pressed into the die, the inner end is extruded to the reduced diameter of the throat 17.

A cooperating tool 21 mounted on a header slide 22 is carried forward to the forward dead center position illustrated, and as it moves forward the blank or workpiece 15 is pressed into the die until the inner end engages the forward end 23 of a knockout pin 24 to prevent further movement of the workpiece into the dies. When this occurs, continued forward movement of the punch causes a head 26 to be formed on the outer end of the workpiece 15, and the filling of the washer face cavity 14.

Positioned against the inner end of the die 16 is a backup ring 27 having a central passage 28 aligned with the throat 17 in the die 16 and through which the ejector pin 24 fits with a close fit. A backup plate 29 is positioned behind the backup ring 27, and such backup plate 29 is seated against the bed frame 31 of the machine. Mounted in the bed frame 31 is an ejection system providing an opening 32 along which the knockout pin 24 extends with substantial clearance. The rearward end of the knockout pin 24 is mounted in a rearward guide 33 which engages a larger diameter ejector rod 34. In the upper portion of FIG. 1, the ejector rod 34 is illustrated in its rearwardmost or retracted position in which it supports the inner or rearward end of the knockout pin during the forming operations.

The rod 34 is moved forward after the work stroke is completed to a position as illustrated in the lower portion of the Figure, where its forward end is located at 36, and during such movement the knockout pin 24 is carried forward until the forward end thereof is substantially at the face of the die 13. During such movement, the workpiece is ejected from the die and is gripped by the transfer (not illustrated) which transports the workpiece to the next work station.

In the rearward position of the knockout pin 24 and the ejector rod 34, the knockout pin is supported at three spaced locations by support members 36, 37 and 38 which have a central bore through which the pin extends with a sliding fit. Consequently, the length of the knockout pin 24 is divided into four unsupported sections 41, 42, 43, and 44. The unsupported sections or portions 41 to 44 are preferably uniform in length and are preferably no longer than about ten times the diameter of the knockout pin 24.

Figure 2A:
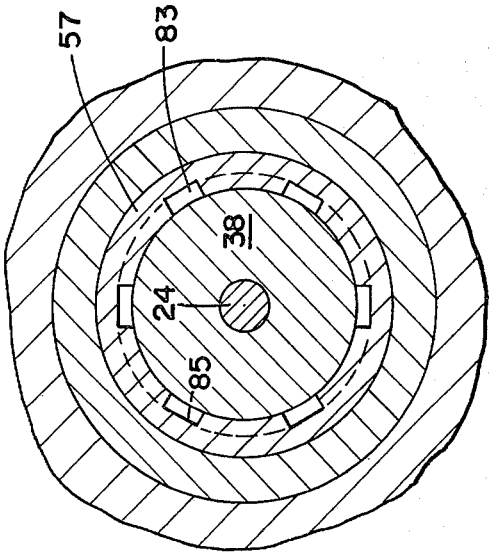
FIG. 2A is a fragmentary cross section taken along 2A—2A of FIG. 2.
Figure 2:
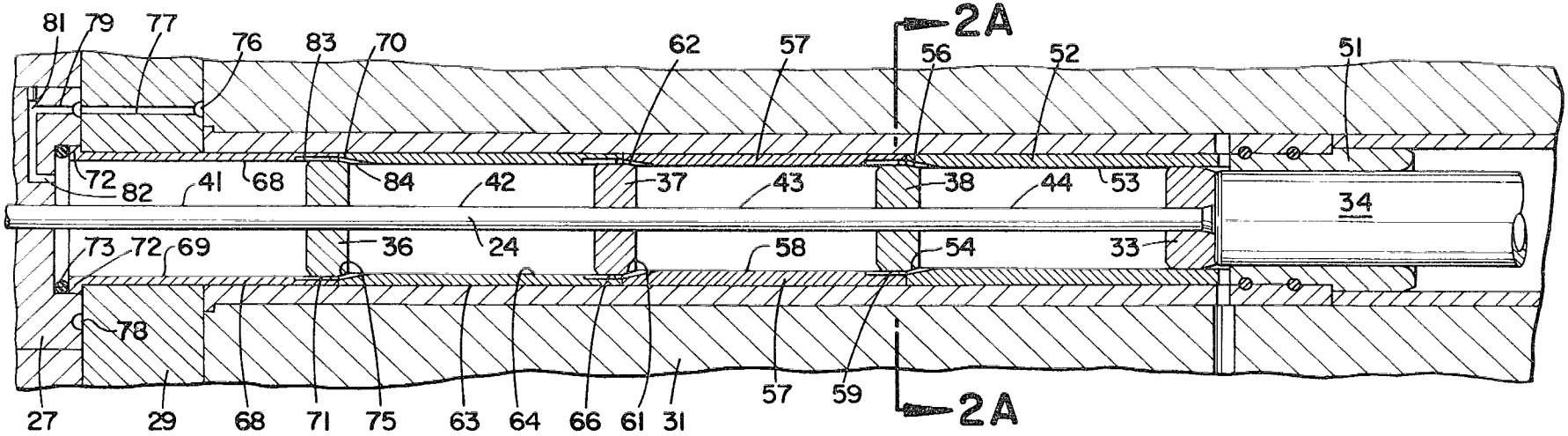
FIG. 2 is an enlarged, fragmentary, longitudinal section of the knockout support system, with the knockout pin in the fully retracted position.

Reference should now be made to FIGS. 2 through 5, which illustrate in greater detail the structure of the ejector pin and its support system. In FIG. 2, the knockout pin 24 and the ejector pin 34 are illustrated in the rearwardmost position. In such position, the forward end of the ejector rod 34 is located substantially adjacent to a guide bearing 51, and the three guide members 36 through 38 are in their normal spaced positions. Extending forward from the bearing 51 is a first sleeve 52 having an inner diameter 53 sized to fit the outer diameter of the guide 33 with a sliding close fit. The forward end of the sleeve 52 is formed with an inclined ramp 54, which engages a corresponding conical surface 56 on the inner side of the guide member 38 and cooperates therewith to provide an abutment or stop limiting the movement of the guide member 38 toward the right as viewed in FIG. 2. Forwardly from the sleeve 52 is a second sleeve 57 having an inner diameter 58 greater than the diameter 53 and sized to provide a sliding fit with the outer cylindrical wall 59 of the guide member 38 so that the guide member 38 is free to slide to the left from the position illustrated. Here again, the sleeve 57 is provided with a ramp surface 61 which mates with a conical surface 62 on the guide member 37 to limit movement to the right of the guide member 37 beyond its predetermined support position illustrated in FIG. 2.

Positioned forward from the sleeve 57 is still another sleeve 63 having an inner diameter 64 providing a sliding and guiding fit with a cylindrical surface 66 on the guide member 37 so that the guide member 37 is free to slide to the left from the illustrated position. The inner diameter 64 of the sleeve 63 is also large than the inner diameter 58 of the sleeve 57 so the guide member 38 is free to move forward along the sleeve 63 with clearance after it moves past the end of the sleeve 57.

Positioned forwardly of the sleeve 63 is still another sleeve 68 having an inner diameter 69 greater than the diameter 64 of the sleeve 66, and sized to closely fit the cylindrical portion 71 of the guide member 36, so that the guide member 36 is free to slide to the left as shown in FIG. 2 to a position adjacent to the backup ring 27. The forward end of the sleeve 68 is formed with a radial flange 72 which bears against the forward face of the spacer plate 29 and against an O-ring type seal 73 positioned in the spacer or backup ring 27.

A passage system is provided to introduce compressed air to the forward end of the passage formed by the sleeves 52, 57, 63, and 68. Such system includes a lateral groove 76 which extends lengthwise of the plate 29 to connect with a source of air pressure (not illustrated) which is usually connected to shop air or any other suitable source of compressed air. A lateral passage 77 connects the groove 76 to an annular groove 78 formed in the rearward face of the backup ring 27. Such annular groove is provided to ensure connection with the passage 77 regardless of the angular orientation of the backup plate when it is installed. Three passages 79, 81, and 82 cooperate to connect the groove 78 to the forward end of the passage in the sleeve 68 so that compressed air is introduced into the forward end of the passage formed by the sleeves.

The adjacent ends of each of the sleeves 52, 57, 63, and 68 are provided with bypass air grooves 83 and 84, which are peripherally spaced, as illustrated in FIG. 2A, around each of the associated support members 36, 37, and 38 to provide a bypass when each of such support members has moved to its predetermined support position. Such bypass allows the compressed air to flow around the respective support members as each support member reaches its predetermined space position. The compressed air introduced through the port 82 functions to bias each of the support members toward the right, as viewed in the drawings, and to ensure that they move to their proper support positions as the ejector rod 34 is retracted from the extended position. A vent 86 is provided in the bed frame 31 to ensure that back pressure does not develop which would tend to resist movement of the various members to the right.

After the completion of the working stroke on a workpiece contained within the dies, the tool 21 commences to retract. When the tool is clear of the workpiece 15, the ejector rod 34 commences to move to the left by its drive system (not illustrated). As the ejector rod 34 moves toward its extended position, a position illustrated in FIG. 3 occurs, in which the guide member 33 engages the first intermediate support member 38. During such movement, of course, the ejector pin 24 moves to the left, initiating the ejection of the workpiece 15 from the dies, but the air pressure prevents movement of the support members with the pin 24. If for some reason the friction between a guide member and the pin were sufficient to cause such guide member to prematurely start to move from its support position, such movement would close off the associated bypass provided by the grooves and the full air pressure would build up on such support member to prevent further movement.

Figure 4:
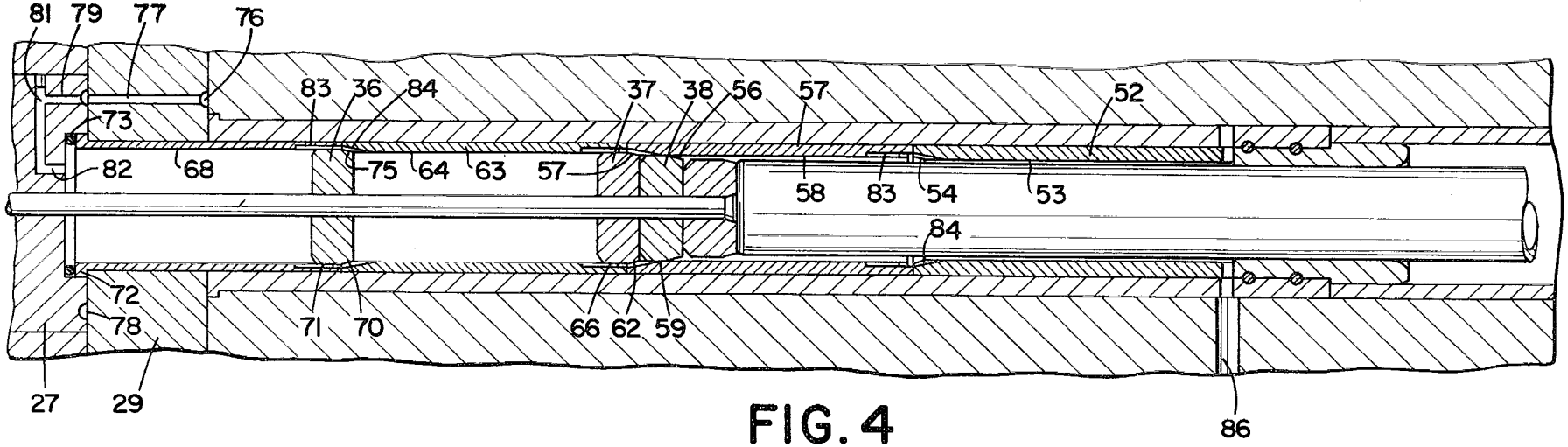
FIG. 4 is a fragmentary section similar to FIG. 2, but illustrating the knockout mechanism in a second intermediate position in which the second support member commences to move with the knockout pin.

As soon as the guide member 33 engages the intermediate guide member 28, continued movement of the ejector rod 34 causes the guide member 38 to slide along the sleeve 53 and ejection continues until the guide member 38 engages the middle guide member 37, as illustrated in FIG. 4. While this occurs, the guide member 36 remains in its predetermined position because of the pressure of the air introduced into the system through the port 82.

Figure 5:
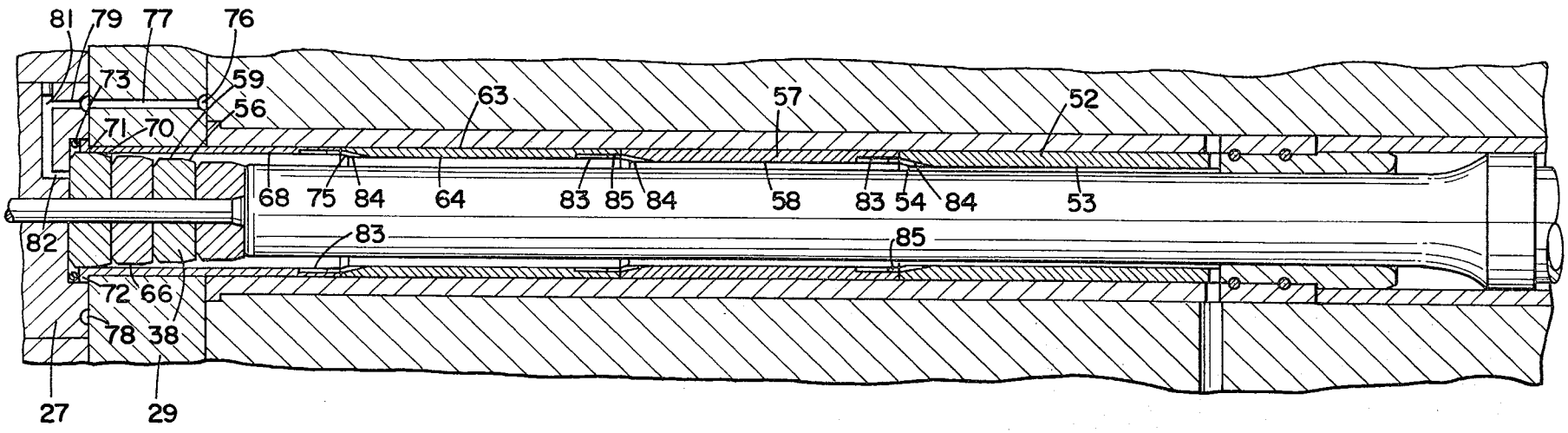
FIG. 5 is an enlarged, fragmentary section similar to FIG. 2 but illustrating the knockout pin in the fully extended position when all of the support members are adjacent the forward end of the passage through which the knockout pin extends.

As ejection continues beyond the position of FIG. 4, the guide members 37 and 38 move to the left until the guide member 36 is engaged and beyond such point until all three of the guide members are positioned adjacent to the forward end of the sleeve 68 and adjacent to the spacer ring 27, as illustrated in FIG. 5.

During the ejection movement, each of the respective guide members 36 remains in its predetermined support position until it is engaged and forced to move from such position. Consequently, the unsupported length of the kickout pin 24 never exceeds the maximum unsupported length determined by the engagement between the respective support members and their sleeves. As a result, the kickout pin is properly supported during the entire ejection operation and is not subject to breakage.

After the ejection operation is completed, the ejector rod is allowed to retract back to the position of FIG. 2. As this occurs, the air pressure acting on the forwardmost support ring 36 causes the three support members 36, 37, and 38 to be moved to the right in engagement with each other and with the guide member 33 until the conical portion 70 on the support member 36 engages the mating ramp 75 on the sleeve 63 to prevent further movement of the forwardmost support member 36. In such position, the support member 36 is properly located in its predetermined support position. During the movement to the right, the relatively close fit between the support member 36 and the inner surface 69 of the sleeve 68 produces a sufficient seal to ensure that the pressure to the left of the support member 36 is greater than the pressure to the right, and this ensures that the three support members all move along together as the retraction is initiated. As soon as the support member 36 reaches its predetermined supporting position, the air under pressure is bypassed around the support member 36 through the grooves 83 and th pressure acts on the forward face of the next support membe, which then closely fits the inner wall 64 of the sleeve 63 to cause the support member 37 to continue to move with the kick-out rod, carrying with its the support member 38. In order to ensure that the grooves 83 in one sleeve communicate with the grooves 84 in the adjacent sleeve regardless of the orientation around their axes, counterbore 85 is provided in the rearward end of each sleeve. This counterbore is illustrated by the dotted line in FIG. 2A because it is beyond the section plane of such Figure.

Figure 3:
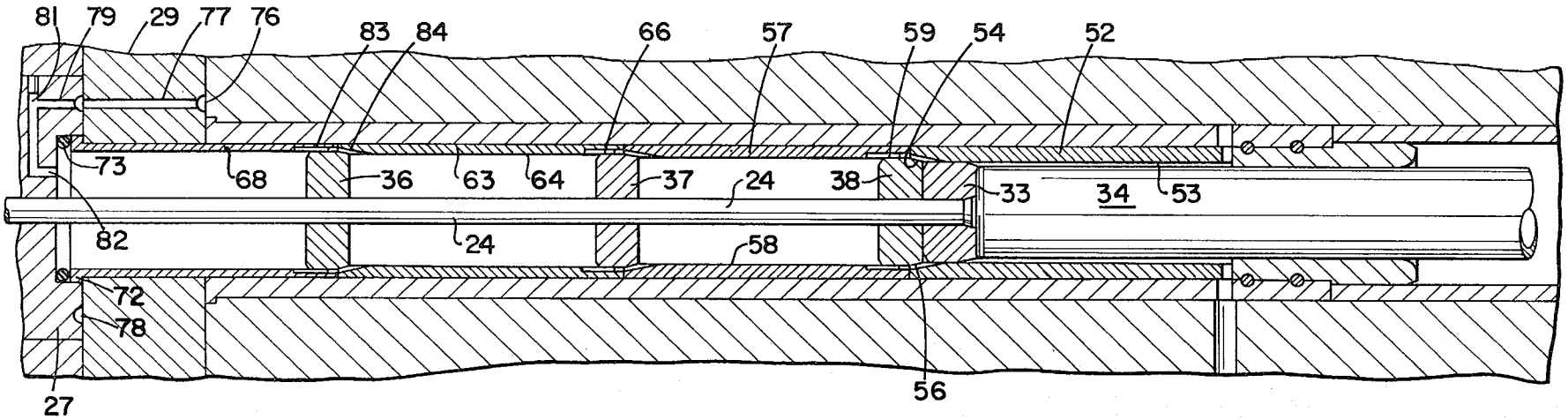
FIG. 3 is an enlarged, fragmentary section similar to FIG. 2, but illustrating the knockout pin at an intermediate point in its stroke in which the rearwardmost support member commences to move with the pin.

When the position illustrated in FIG. 4 is reached, the conical surface 62 engages the ramp 61 on the sleeve 57 and th support member 37 cannot continue to move with the retraction, but remains in its predetermined support position. Here again, the bypass grooves 83 are then opened to allow the air pressure to act on the forward face of the third support member, causing it to continue to move to the right until the position of FIG. 3 is reached. In such position, the movement of the third support member is blocked by engagement of the conical surface 56 and the ramp 54 and the support member 38 is in its proper support position.

Here again, a bypass is provided by the grooves and the air pressure acts on the forward face of the support member 33 to cause it to move with the pin back to the retracted position of FIG. 2. Because the air is vented behind the support member 33, air pressure does not build up to resist such movement.

In effect, the air pressure system provides a pneumatic spring which maintains a bias on the various intermediate support members 36, 37, and 38 to maintain them in their respective predetermined support positions, except when they are mechanically moved from such positions by the movement of the ejector rod 34. Normally, the return of the ejection system to the retracted position is caused by the entry of the subsequent workpiece into the dies and its engagement with the forward end of the knockout pin 24, since such movement occurs rather rapidly and there is sufficient mass and friction to normally prevent the air pressure from causing the ejection system to return to the retracted position with the speed required. However, the air pressure produces sufficient force to overcome the mass and friction of the respective intermediate support members and ensures their movement with the ejector pin to their predetermined locations. However, if the machine operates as sufficiently low speed, the air pressure may be sufficient to produce the retraction movement of the kickout mechanism. In any event, before the completion of the work stroke, the kickout pin is moved to its rearwardmost position, where it absorbs at least part of the upsetting load and the proper positioning of the three support members ensures that the unsupported length of the kickout pin is not excessive at any location therealong.

With this invention, a simple structure is provided to properly support a kickout pin of substantially any length and to ensure that the unsupported length of such pin never exceeds the maximum length to prevent breakage of the pin under normal operation.

It has been found in actual practice that it is not necessary to provide seals on the support member and proper operation has been achieved with the use of shop air at normal pressures of about 80 to 100 psi.

Although the preferred embodiment of this invention has been shown and described, it should be understood that various modifications and rearrangements of the parts may be resorted to without departing from the scope of the invention as disclosed and claimed herein.

What is claimed is:

1. A forging machine comprising a frame, a die on said frame having a die opening therein, a passage in said frame aligned with said opening, a knockout pin movable with clearance along said passage between a retracted position and an extended position, movement of said knockout pin to said extended position causing it to move in along said opening, and support means in said passage operable to support said pin intermediate its ends, said support means including a plurality of support members through which said pin extends and which are slidable thereon, said support members each being movable along said passage to an associated predetermined support position, said support members when in their predetermined support positions being spaced along said pin and cooperating to support said pin at spaced locations therealong, movement of said pin to said extended position causing said support members to move from their associated predetermined support positions along said passage toward said opening, and return means operable to return said support members to their associated predetermined support positions when said knockout pin moves to said retracted position.

2. A forging machine as set forth in claim 1, wherein said support means are spaced to provide unsupported portions of equal length along said knockout pin when said knockout pin is in said retracted position.

3. A forging machine as set forth in claim 1, wherein stop means are provided to prevent each support member from moving in a retraction direction beyond its associated predetermined support position without limiting movement of said support members in the opposite direction.

4. A forging machine as set forth in claim 3 wherein said return means includes spring means biasing said support members in said retraction direction.

5. A forging machine as set forth in claim 4, wherein said spring means are provided by fluid under pressure.

6. A forging machine as set forth in claim 1, wherein said passage is generally cylindrical having a plurality of substantially uniform diameter passage portions of progressively increasing diameter in a direction toward said extended position and providing a plurality of radially extending surfaces at the ends of said passage portions, said support members each being sized with a sliding fit with one of said passage portions and engaging one of said radially extending surfaces when in its predetermined support position.

7. A forging machine as set forth in claim 6, wherein said return means are provided by spring means biasing each support member toward its associated radially extending surface.

8. A forging machine as set forth in claim 7, wherein said spring means is provided by fluid under pressure.

9. A forging machine as set forth in claim 6, wherein said return means are provided by fluid under pressure admitted to said passage and operating to move each support member along the passage portion it fits toward an adjacent and associated radially extending surface.

10. A forging machine as set forth in claim 9, wherein said return means is provided by air under pressure admitted to the forward end of said passage which operates to sequentially urge each support member along the passage section it fits toward its associated radially extending surface.

11. A forging machine as set forth in claim 10, wherein said support members divide the total unsupported length of said knockout pin into unsupported portions of equal length when said pin is in said retracted position.

12. A forging machine as set forth in claim 11, wherein said support members are never spaced apart by a distance greater than their spacing when said knockout pin is in said retracted position.

13. A forging machine as set forth in claim 10, wherein bypass means are provided around said support members when said support members are in their predetermined support positions.

14. A forging machine as set forth in claim 13, wherein said bypass means include grooves formed in the surface of said passage at peripherally spaced locations and which extend axially of said passage a distance greater than the thickness of said support members, said grooves providing fluid communication between the two sides of a support member located in its predetermined support position.

15. A forging machine as set forth in claim 14, wherein said radially extending surface is generally conical and said each support member is provided with a conical mating surface.

16. A forging machine comprising a frame, a die on said frame having a die opening therein, a passage in said frame aligned with said opening, a knockout pin movable with clearance along said passage between a retracted position and an extended position, movement of said knockout pin to said extended position causing it to move along said opening, a support memberin said passage operable to support said pin intermediate its ends, said support member being slidable with respect to said pin and slidable with respect to said passage, said support member being located in a predetermined support position along the length of said passage when said knockout pin is in said retracted position, movement of said knockout pin to said extended position causing said support member to move from said predetermined support position along said passage toward said opening, and fluid pressure means operable to return said support member to its predetermined support position when said knockout pin moves to said retracted position.

17. A forging machine as set forth in claim 16, wherein said passage includes a cylindrical passage portion and a radially extending surface at the end thereof, said support member being sized to provide a sliding fit with said passage portion and engaging said radially extending surface when in its predetermined support position.

18. A forging machine as set forth in claim 17, wherein there are a plurality of support members and a plurality of associated cylindrical passage portions and radially extending surfaces, and bypass means are provided to provide fluid communication between opposite sides of each support member when said support members are in said predetermined support position.

* * * * *